US009305507B2

(12) United States Patent
Yamakawa

(10) Patent No.: US 9,305,507 B2
(45) Date of Patent: Apr. 5, 2016

(54) LIQUID CRYSTAL DISPLAY DEVICE CAPABLE OF PERFORMING 2D DISPLAY AND 3D DISPLAY, AND DRIVE METHOD THEREOF

(71) Applicant: Sharp Kabushiki Kaisha, Osaka-shi, Osaka (JP)

(72) Inventor: Ryo Yamakawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 102 days.

(21) Appl. No.: 14/351,915

(22) PCT Filed: Jan. 18, 2013

(86) PCT No.: PCT/JP2013/050887
§ 371 (c)(1),
(2) Date: Apr. 15, 2014

(87) PCT Pub. No.: WO2013/111675
PCT Pub. Date: Aug. 1, 2013

(65) Prior Publication Data

US 2014/0240301 A1 Aug. 28, 2014

(30) Foreign Application Priority Data

Jan. 25, 2012 (JP) ..... 2012-013486

(51) Int. Cl.
*G09G 3/36* (2006.01)
*G09G 3/00* (2006.01)

(52) U.S. Cl.
CPC ..... *G09G 3/3674* (2013.01); *G09G 3/3614* (2013.01); *G09G 3/3648* (2013.01); *G09G 3/003* (2013.01); *G09G 3/3607* (2013.01);

(Continued)

(58) Field of Classification Search
CPC ..... G09G 3/3614; G09G 3/3648
See application file for complete search history.

(56) References Cited

U.S. PATENT DOCUMENTS 5,430,460 A * 7/1995 Takabatake ..... G09G 3/3648 345/209
6,650,311 B1 11/2003 Mori (Continued)

FOREIGN PATENT DOCUMENTS

JP 11-133376 A 5/1999
JP 2005-165038 A 6/2005

(Continued)

OTHER PUBLICATIONS

Official Communication issued in International Patent Application No. PCT/JP2013/050887, mailed on Apr. 23, 2013.

*Primary Examiner* — Ram Mistry
(74) *Attorney, Agent, or Firm* — Keating & Bennett, LLP

(57) ABSTRACT

An object of the present invention is to prevent screen burn-in in a liquid crystal display device that performs a plurality of types of frame-reversal driving. When any gate bus line is focused, among a plurality of pixel electrodes in a display unit, pixel electrodes provided in pixel formation portions to which a scanning signal is provided from the focused gate bus line are arranged in a staggered manner with the focused gate bus line centered. A latch strobe signal (LS) including pulses where in each pixel formation portion a length of a period (TA1) during which a positive polarity voltage is applied to a liquid crystal is longer than a length of a period (TA2) during which a negative polarity voltage is applied to the liquid crystal is provided to a source driver from a display control circuit.

3 Claims, 8 Drawing Sheets

(52) U.S. Cl.
CPC .... *G09G2300/0426* (2013.01); *G09G 2320/02* (2013.01); *G09G 2320/0209* (2013.01)

(56) References Cited

U.S. PATENT DOCUMENTS

2002/0089485 A1* 7/2002 Youn ..... G09G 3/3614 345/99
2005/0104835 A1* 5/2005 Misonou ..... G09G 3/3614 345/96
2007/0063233 A1* 3/2007 Joo ..... G02F 1/134336 257/291
2010/0182297 A1 7/2010 Lan et al.

FOREIGN PATENT DOCUMENTS

JP 2007-025662 A 2/2007
JP 2010-170078 A 8/2010
JP 2011-227375 A 11/2011

* cited by examiner

LIQUID CRYSTAL DISPLAY DEVICE CAPABLE OF PERFORMING 2D DISPLAY AND 3D DISPLAY, AND DRIVE METHOD THEREOF

TECHNICAL FIELD

The present invention relates to a liquid crystal display device, and more particularly to a liquid crystal display device capable of performing 2D display and 3D display.

BACKGROUND ART

In recent years, many liquid crystal display devices capable of performing 3D display (stereoscopic vision) such as 3D television devices have been on the market. In a liquid crystal display device adopting a frame-sequential method which is one of the methods for achieving 3D display, a left-eye image and a right-eye image are alternately displayed on a liquid crystal panel every predetermined period of time (e.g., every 1/120 second), and the lenses of active shutter glasses alternately open and close one at a time in synchronization with the display. In this manner, an image with parallax between left and right eyes is visually recognized, and accordingly, a viewer perceives the image as a stereo image.

As for liquid crystal display devices capable of performing 3D display, a reduction in crosstalk is a conventional issue. Crosstalk is a phenomenon where a left-eye image is also captured by a viewer's right eye and a right-eye image is also captured by a viewer's left eye, and accordingly, an image where the left-eye image and the right-eye image overlap each other is visually recognized. To prevent such crosstalk or to improve the performance of moving image display, a black image display period is inserted between a left-eye image display period and a right-eye image display period. For example, in the case where image display periods are switched every frame period such as "a left-eye image display period, a black image display period, a right-eye image display period, and a black image display period", when the polarity of a liquid crystal application voltage is reversed every frame period such as "positive, negative, positive, and negative" (such a drive method is referred to as "one-frame-reversal driving"), the polarity of the liquid crystal application voltage for the left-eye image display periods and the right-eye image display periods is always positive, and the polarity of the liquid crystal application voltage for the black image display periods is always negative. As a result, a bias occurs in the polarity of the liquid crystal application voltage, causing screen burn-in. Hence, when black image display periods are inserted, by reversing the polarity of the liquid crystal application voltage every two frame periods such as "positive, positive, negative, and negative" (or every four frame periods, etc.) (such a drive method is referred to as "multi-frame-reversal driving"), screen burn-in is prevented.

Note that in connection with this invention, Japanese Patent Application Laid-Open No. 2010-170078 discloses an invention of a liquid crystal display device capable of increasing charge time. In the liquid crystal display device, data lines are split into a plurality of lines to split write time, enabling to ensure a relatively high charge rate with a relatively short charge time.

PRIOR ART DOCUMENT

Patent Document

[Patent Document 1] Japanese Patent Application Laid-Open No. 2010-170078

SUMMARY OF THE INVENTION

Problems to be Solved by the Invention

In a liquid crystal display device, in general, a common electrode is provided so as to face pixel electrodes with a liquid crystal therebetween. A certain fixed voltage is set for the common electrode (hereinafter, the common electrode voltage is also referred to as "Vcom"). The value of Vcom is determined such that the above-described burn-in does not occur, which will be described with reference to FIGS. 9 and 10.

FIG. 9 is a waveform diagram showing changes in pixel voltage for when ideal driving is performed in a liquid crystal display device. In FIG. 9, a period from a time point t91 to a time point t92 is a period during which positive polarity writing (charging) into a pixel capacitance is performed (hereinafter, referred to as a "positive polarity charge period"), and a period from the time point t92 to a time point t93 is a period during which negative polarity writing (charging) into the pixel capacitance is performed (hereinafter, referred to as a "negative polarity charge period") (the same also applies to FIG. 10). The pixel voltage is maintained at 15.2 V during the period from the time point t91 to the time point t92, and is maintained at 0.2 V during the period from the time point t92 to the time point t93. Since the pixel voltage is thus maintained at 15.2 V or 0.2 V, by setting the value of Vcom to 7.7 V which is a median value between 15.2 V and 0.2 V, the charge rate for the positive polarity charge period and the charge rate for the negative polarity charge period can be made equal to each other. Note that Vcom at which the charge rate for the positive polarity charge period and the charge rate for the negative polarity charge period are equal to each other (Vcom at which burn-in is least likely to occur) is referred to as "optimum Vcom". In the example shown in FIG. 9, the value of optimum Vcom is 7.7 V which is a median value between 15.2 V and 0.2 V.

Ideally, the pixel voltage changes as shown in FIG. 9; however, in practice, the pixel voltage changes as shown in FIG. 10 due to the influence of a field-through voltage (pull-in voltage) caused by the presence of a parasitic capacitance Csd between the source and drain of a pixel TFT and a parasitic capacitance Cgd between the gate and drain of the pixel TFT. Specifically, the pixel voltage is lower than 15.2 V during the most part of the period from the time point t91 to the time point t92, and is lower than 0.2 V during the most part of the period from the time point t92 to the time point t93. Due to this, if the value of Vcom is set to 7.7 V, the charge rate for the negative polarity charge period is higher than that for the positive polarity charge period. As a result, burn-in occurs. Accordingly, in order not to cause burn-in, the value of Vcom is set to a voltage lower than 7.7 V. Typically, the value of Vcom is set to the value of optimum Vcom (e.g., 6.5 V).

Meanwhile, the magnitude of the influence of the field-through voltage on the charge rate of the pixel capacitance varies depending on the polarity reversal cycle of the liquid crystal application voltage. Therefore, the value of optimum Vcom varies between one-frame-reversal driving and multi-frame-reversal driving. In general, the value of optimum Vcom is lower for one-frame-reversal driving than for multi-frame-reversal driving. However, in one liquid crystal display device, normally, only one value of Vcom is set. Therefore, in a liquid crystal display device configured to perform switching between one-frame-reversal driving and two-frame-reversal driving in response to switching between 2D display and 3D display, the value of Vcom is set to an intermediate value between the value of optimum Vcom for 2D display (one-frame-reversal driving) and the value of optimum Vcom for 3D display (two-frame-reversal driving), or is set to a value equal to the value of optimum Vcom for 2D display (one-frame-reversal driving) which is generally high in frequency of use. However, screen burn-in is not sufficiently prevented.

An object of the present invention is therefore to prevent screen burn-in in a liquid crystal display device that performs a plurality of types of frame-reversal driving (e.g., "one-frame-reversal driving" and "two-frame-reversal driving").

Means for Solving the Problems

A first aspect of the present invention is directed to an active matrix-type liquid crystal display device comprising:

a plurality of video signal lines for transmitting a plurality of video signals, respectively, the video signals representing an image to be displayed;

a plurality of scanning signal lines that intersect the plurality of video signal lines;

a plurality of pixel electrodes provided in a plurality of pixel formation portions, respectively, the pixel formation portions being arranged in a matrix corresponding respectively to intersections of the plurality of video signal lines and the plurality of scanning signal lines;

a common electrode provided so as to be shared by the plurality of pixel electrodes, and provided so as to face the plurality of pixel electrodes with a liquid crystal therebetween;

a video signal line drive circuit that outputs the plurality of video signals to the plurality of video signal lines; and a scanning signal line drive circuit that outputs a plurality of scanning signals to sequentially drive the plurality of scanning signal lines, wherein when any scanning signal line is focused, among the plurality of pixel electrodes, pixel electrodes provided in pixel formation portions to which the corresponding scanning signal is provided from the focused scanning signal line are arranged in a staggered manner with the focused scanning signal line centered, and in each pixel formation portion, a period during which a positive polarity voltage is applied to the liquid crystal is longer than a period during which a negative polarity voltage is applied to the liquid crystal.

According to a second aspect of the present invention, in the first aspect of the present invention, the liquid crystal display device further comprises a display control circuit that controls operation of the video signal line drive circuit and the scanning signal line drive circuit, and that generates a latch strobe signal including pulses and provides the latch strobe signal to the video signal line drive circuit, the pulses indicating timing of change in voltages of the plurality of video signals outputted from the video signal line drive circuit, wherein when a period from a time point of generation of a pulse for changing the voltages of the plurality of video signals so as to change a polarity of a voltage applied to the liquid crystal from negative to positive to a time point of generation of a pulse for changing the voltages of the plurality of video signals so as to change the polarity of the voltage applied to the liquid crystal from positive to negative is defined as a first charge period, and a period from a time point of generation of a pulse for changing the voltages of the plurality of video signals so as to change the polarity of the voltage applied to the liquid crystal from positive to negative to a time point of generation of a pulse for changing the voltages of the plurality of video signals so as to change the polarity of the voltage applied to the liquid crystal from negative to positive is defined as a second charge period, the display control circuit generates, as the latch strobe signal, a signal including pulses where the first charge period is longer than the second charge period.

According to a third aspect of the present invention, in the first aspect of the present invention, one-frame-reversal driving where a polarity of a voltage applied to the liquid crystal is reversed every frame and multi-frame-reversal driving where the polarity of the voltage applied to the liquid crystal is reversed every multiple frames are switchable, and when at least the one-frame-reversal driving is performed, in each pixel formation portion, a period during which a positive polarity voltage is applied to the liquid crystal is longer than a period during which a negative polarity voltage is applied to the liquid crystal.

According to a fourth aspect of the present invention, in the third aspect of the present invention, when a length of a period during which a positive polarity voltage is applied to the liquid crystal in each pixel formation portion when the one-frame-reversal driving is performed is T1*a*, a length of a period during which a negative polarity voltage is applied to the liquid crystal in each pixel formation portion when the one-frame-reversal driving is performed is T1*b*, a length of a period during which a positive polarity voltage is applied to the liquid crystal in each pixel formation portion when the multi-frame-reversal driving is performed is T2*a*, and a length of a period during which a negative polarity voltage is applied to the liquid crystal in each pixel formation portion when the multi-frame-reversal driving is performed is T2*b*, a following equation holds:

$$T1a>T2a>T2b>T1b.$$

According to a fifth aspect of the present invention, in the first aspect of the present invention, the liquid crystal display device further comprises a gray scale voltage generating circuit that generates a plurality of gray scale voltages including positive polarity side and negative polarity side voltages corresponding to displayable gray scales, the gray scale voltages being voltages to be outputted from the video signal line drive circuit, as the video signals, wherein a voltage value of the common electrode is set such that a charge rate for a period during which a positive polarity voltage is applied to the liquid crystal and a charge rate for a period during which a negative polarity voltage is applied to the liquid crystal are equal to each other when display of a maximum gray scale is performed, and in the gray scale voltage generating circuit, values of positive polarity side and negative polarity side gray scale voltages corresponding to each gray scale other than the maximum gray scale among the plurality of gray scale voltages are set such that a charge rate for a period during which a positive polarity voltage is applied to the liquid crystal and a charge rate for a period during which a negative polarity voltage is applied to the liquid crystal are equal to each other when display of the gray scale is performed.

A sixth aspect of the present invention is directed to a drive method for an active matrix-type liquid crystal display device including: a plurality of video signal lines for transmitting a plurality of video signals, respectively, the video signals representing an image to be displayed; a plurality of scanning signal lines that intersect the plurality of video signal lines; a plurality of pixel electrodes provided in a plurality of pixel formation portions, respectively, the pixel formation portions being arranged in a matrix corresponding respectively to intersections of the plurality of video signal lines and the plurality of scanning signal lines; and a common electrode provided so as to be shared by the plurality of pixel electrodes, and provided so as to face the plurality of pixel electrodes with a liquid crystal therebetween, the drive method comprising:

a video signal line driving step of outputting the plurality of video signals to the plurality of video signal lines; and a scanning signal line driving step of outputting a plurality of scanning signals to sequentially drive the plurality of scanning signal lines, wherein when any scanning signal line is focused, among the plurality of pixel electrodes, pixel electrodes provided in pixel formation portions to which the corresponding scanning signal is provided from the focused scanning signal line are arranged in a staggered manner with the focused scanning signal line centered, and in the video signal line driving step, the plurality of video signals are outputted to the plurality of video signal lines, and in the scanning signal line driving step, the plurality of scanning signals are outputted, such that in each pixel formation portion a period during which a positive polarity voltage is applied to the liquid crystal is longer than a period during which a negative polarity voltage is applied to the liquid crystal.

EFFECTS OF THE INVENTION

According to the first aspect of the present invention, a pixel structure is adopted in which, when one scanning signal line is focused, pixel formation portions that receive supply of a scanning signal from the focused scanning signal line are arranged alternately on both sides of the focused scanning signal line. Hence, while dot-reversal driving (a drive method in which the polarities of a liquid crystal application voltage for any two adjacent pixel formation portions are reversed from each other) is achieved, the length of a charge period for one polarity and the length of a charge period for the other polarity can be made different from each other. A positive polarity charge period is longer than a negative polarity charge period. By this, the value of optimum Vcom (a common electrode voltage at which the charge rate for the positive polarity charge period and the charge rate for the negative polarity charge period are equal to each other) can be set to be near a median value of a video signal voltage. Therefore, even when a plurality of types of frame-reversal driving are performed in one liquid crystal display device, by allowing the values of optimum Vcom for each reversal driving to coincide with each other, the occurrence of screen burn-in is prevented.

According to the second aspect of the present invention, by changing the timing of generation of pulses of a latch strobe signal generated by the display control circuit, the positive polarity charge period can be relatively easily made longer than the negative polarity charge period.

According to the third aspect of the present invention, by making the positive polarity charge period longer than the negative polarity charge period when at least one-frame-reversal driving is performed, the occurrence of screen burn-in is prevented in a liquid crystal display device that performs a plurality of types of frame-reversal driving.

According to the fourth aspect of the present invention, the lengths of the positive polarity charge period and the negative polarity charge period are set taking into account the magnitude of the influence of a field-through voltage on the charge rate for each frame-reversal driving. Thus, the occurrence of screen burn-in is more effectively prevented in a liquid crystal display device that performs a plurality of types of frame-reversal driving.

According to the fifth aspect of the present invention, by setting the value of a common electrode voltage and the value of each gray scale voltage to suitable values, the occurrence of screen burn-in is prevented in a liquid crystal display device that performs a plurality of types of frame-reversal driving.

According to the sixth aspect of the present invention, the same effect as that obtained in the first aspect of the present invention can be obtained in an invention of the drive method for a liquid crystal display device.

MODE FOR CARRYING OUT THE INVENTION

An embodiment of the present invention will be described below with reference to the accompanying drawings.

<1. Overall Configuration and Summary of Operation>

Figure 2:
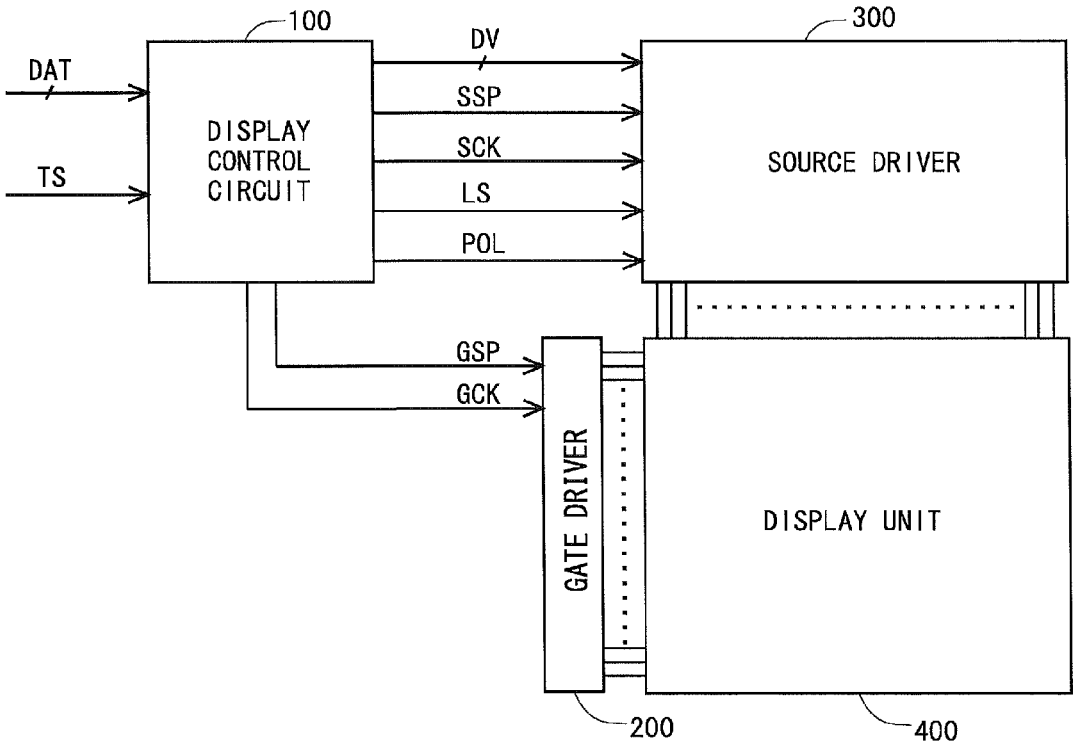
FIG. 2 is a block diagram showing an overall configuration of the liquid crystal display device in the embodiment.
Figure 3:
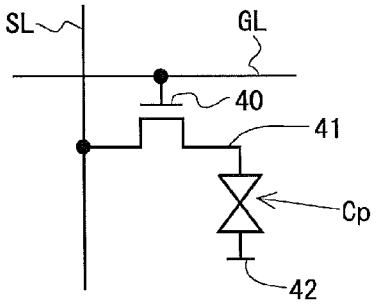
FIG. 3 is a circuit diagram showing a configuration of a pixel formation portion in the embodiment.

FIG. 2 is a block diagram showing an overall configuration of a liquid crystal display device according to an embodiment of the present invention. The liquid crystal display device includes a display control circuit 100, a gate driver (scanning signal line drive circuit) 200, a source driver (video signal line drive circuit) 300, and a display unit 400. The display unit 400 includes a plurality of source bus lines, a plurality of gate bus lines, and a plurality of pixel formation portions provided corresponding respectively to the intersections of the plurality of source bus lines and the plurality of gate bus lines. As shown in FIG. 3, each pixel formation portion includes a thin film transistor (TFT) 40 which is a switching element connected at its gate terminal to a gate bus line GL passing through a corresponding intersection, and connected at its source terminal to a source bus line SL passing through the intersection; a pixel electrode 41 connected to the drain terminal of the thin film transistor 40; a common electrode 42 which is a counter electrode for providing a common voltage to the plurality of pixel formation portions; and a liquid crystal layer provided so as to be shared by the plurality of pixel formation portions, and sandwiched between the pixel electrode 41 and the common electrode 42. By a liquid crystal capacitance formed by the pixel electrode 41 and the common electrode 42, a pixel capacitance Cp is formed. In general, an auxiliary capacitance is provided in parallel with the liquid crystal capacitance so as to securely hold a voltage in the pixel capacitance Cp; however, the auxiliary capacitance is not directly related to the present invention and thus the description and depiction thereof are omitted.

The display control circuit 100 receives an image signal DAT and timing signals TS such as a horizontal synchronizing signal and a vertical synchronizing signal, which are transmitted from an external source, and outputs a digital video signal DV, a source start pulse signal SSP, a source clock signal SCK, a latch strobe signal LS, and a polarity reversal signal POL which are for controlling the operation of the source driver 300, and a gate start pulse signal GSP and a gate clock signal GCK which are for controlling the operation of the gate driver 200.

The gate driver 200 repeats application of active scanning signals to the respective gate bus lines based on the gate start pulse signal GSP and the gate clock signal GCK which are outputted from the display control circuit 100, in cycles of one vertical scanning period.

The source driver 300 receives the digital video signal DV, the source start pulse signal SSP, the source clock signal SCK, the latch strobe signal LS, and the polarity reversal signal POL which are outputted from the display control circuit 100, and applies driving video signals to the source bus lines, respectively, to charge the pixel capacitances of the respective pixel formation portions in the display unit 400. Note that a detailed configuration of the source driver 300 will be described later.

In the above-described manner, the driving video signals are applied to the source bus lines, respectively, and the scanning signals are applied to the gate bus lines, respectively, by which an image based on the image signal DAT transmitted from the external source is displayed on the display unit 400.

<2. Pixel Structure>

Figure 4:
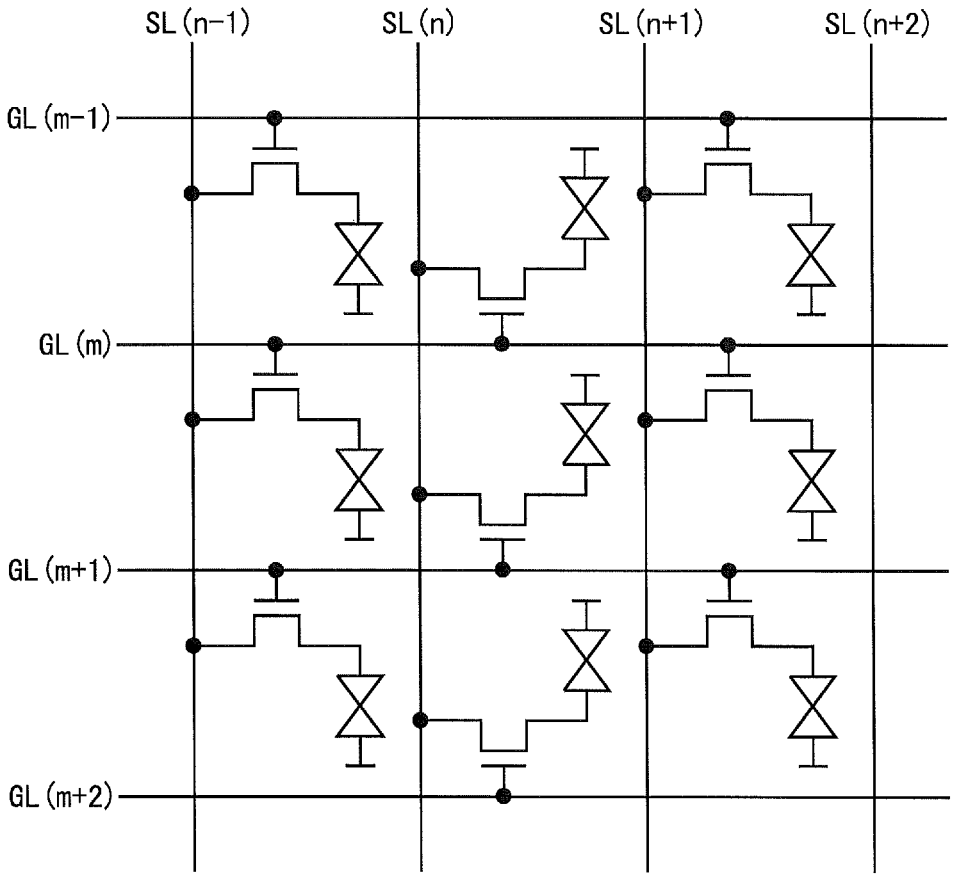
FIG. 4 is a schematic diagram showing a pixel structure in the embodiment.

FIG. 4 is a schematic diagram showing a pixel structure in the present embodiment. Note that FIG. 4 shows an area in the neighborhood of the intersection of an mth row gate bus line and an nth column source bus line. In FIG. 4, for example, when the mth row gate bus line GL(m) is focused, a pixel formation portion provided corresponding to the intersection of the gate bus line GL(m) and a source bus line SL(n−1) is arranged on the lower side of the gate bus line GL(m), a pixel formation portion provided corresponding to the intersection of the gate bus line GL(m) and the source bus line SL(n) is arranged on the upper side of the gate bus line GL(m), and a pixel formation portion provided corresponding to the intersection of the gate bus line GL(m) and a source bus line SL(n+1) is arranged on the lower side of the gate bus line GL(m−1). The same also applies to an (m−1) th row gate bus line GL(m−1) and also applies to an (m+1) th row gate bus line GL(m+1). As such, in the present embodiment, when one gate bus line is focused, pixel formation portions to which a scanning signal is provided from the gate bus line are arranged alternately on both sides of the gate bus line. In other words, pixel formation portions to which a scanning signal is provided from each gate bus line are arranged in a staggered manner with the gate bus line centered. In still other words, when any gate bus line is focused, among the plurality of pixel electrodes 41 formed in the display unit 400, pixel electrodes 41 provided in pixel formation portions to which a scanning signal is provided from the focused gate bus line are arranged in a staggered manner with the focused gate bus line centered.

Figure 5:
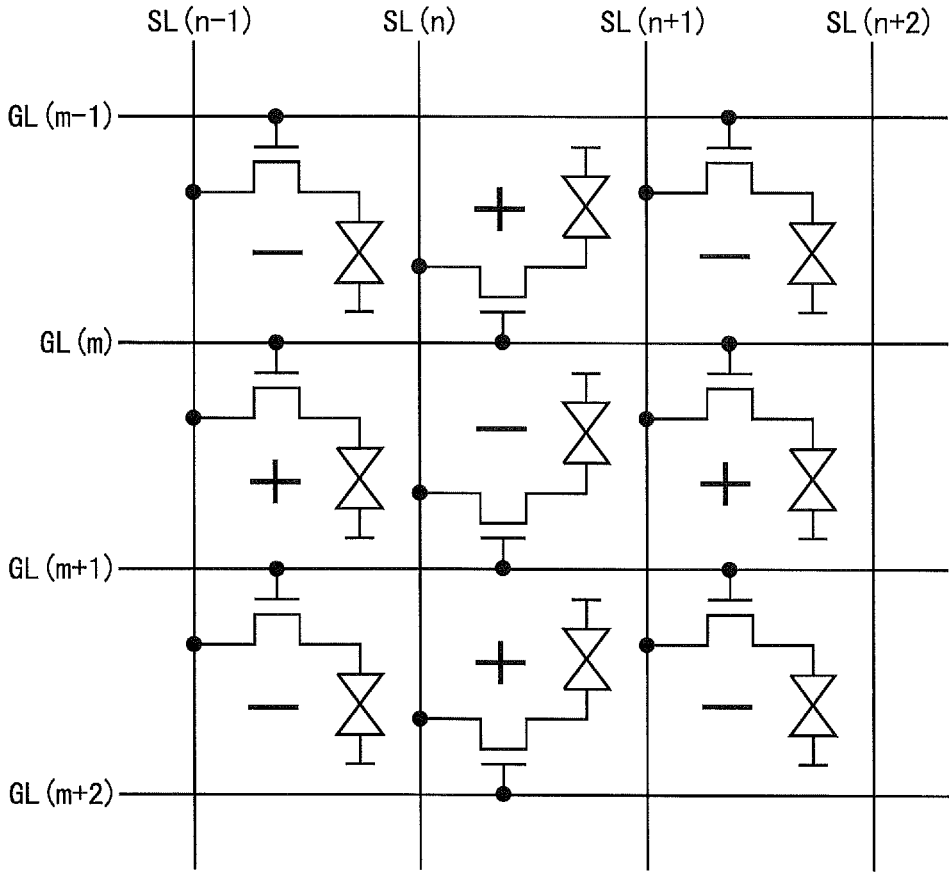
FIG. 5 is a diagram showing the polarities of a liquid crystal application voltage for pixel formation portions in a certain frame in the embodiment.

Meanwhile, in the present embodiment, at any time point, video signals applied to all source bus lines have the same polarity. Specifically, when positive polarity video signals are applied to all source bus lines during a certain horizontal scanning period, negative polarity video signals are applied to all source bus lines during the next horizontal scanning period. Here, since a pixel structure such as that shown in FIG. 4 is adopted in the present embodiment, for both of the direction in which the gate bus lines extend and the direction in which the source bus lines extend, the polarities of a liquid crystal application voltage for any two adjacent pixel formation portions are reversed from each other (see FIG. 5).

<3. Configuration and Operation of the Source Driver>

Figure 6:
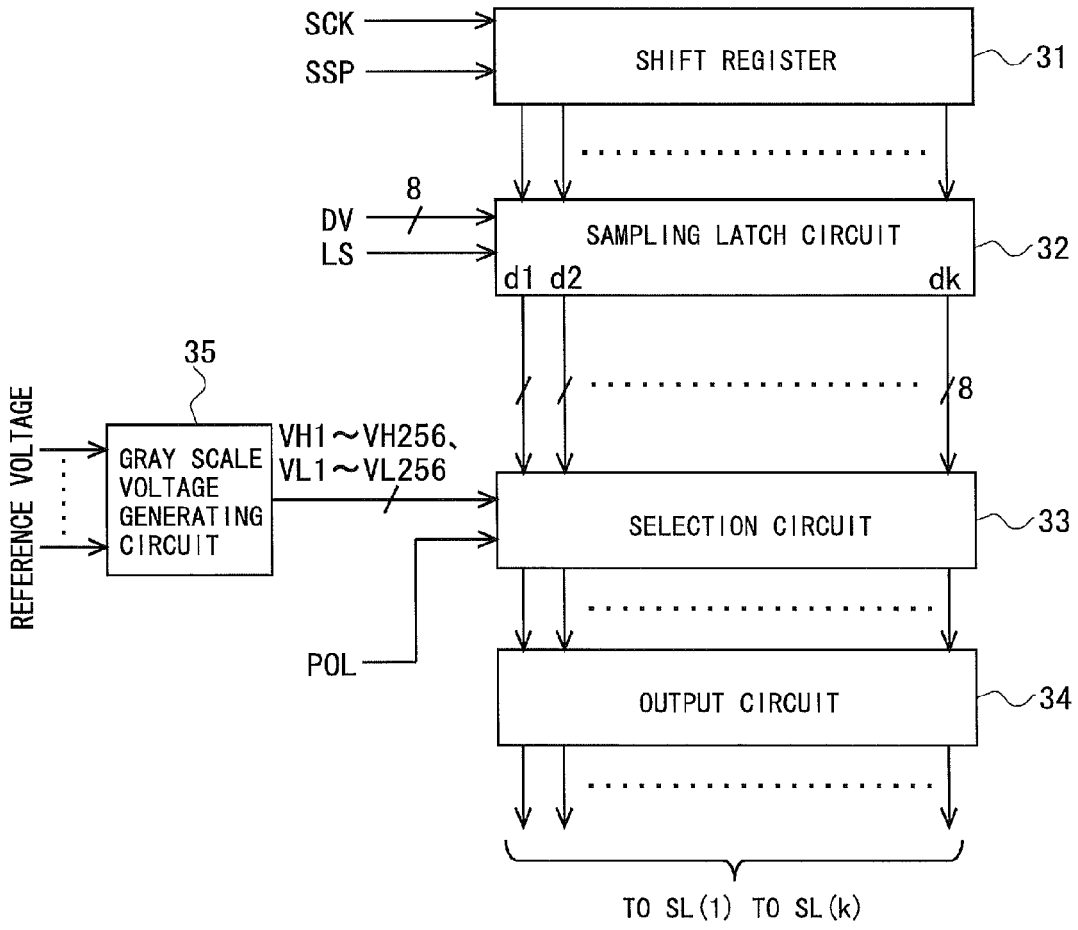
FIG. 6 is a block diagram showing a configuration of a source driver in the embodiment.

FIG. 6 is a block diagram showing a configuration of the source driver 300 in the present embodiment. Note that here it is assumed that there are k source bus lines and 256 gray scale representation is possible. The source driver 300 includes a k-stage shift register 31; a sampling latch circuit that outputs 8-bit digital image signals d1 to dk corresponding to the source bus lines SL(1) to SL(k), respectively; a selection circuit 33 for selecting voltages to be applied to the source bus lines SL(1) to SL(k), respectively; an output circuit 34 for applying the voltages selected by the selection circuit 33 to the source bus lines SL(1) to SL(k), as driving video signals; and a gray scale voltage generating circuit 35 that outputs voltages corresponding to positive polarity and negative polarity 256 gray scale levels, respectively.

A source start pulse signal SSP and a source clock signal SCK are inputted to the shift register 31. The shift register 31 sequentially transfers pulses included in the source start pulse signal SSP from an input end to an output end, based on the source clock signal SCK. In response to the transfer of the pulses, sampling pulses corresponding to the source bus lines SL(1) to SL(k), respectively, are sequentially outputted from the shift register 31, and the sampling pulses are sequentially inputted to the sampling latch circuit 32.

The sampling latch circuit 32 samples an 8-bit digital video signal DV outputted from the display control circuit 100, at the timing of a sampling pulse outputted from the shift register 31, and holds the 8-bit digital video signal DV. Furthermore, the sampling latch circuit 32 simultaneously outputs the held digital video signal DV as 8-bit internal image signals d1 to dk, at the timing of a pulse of a latch strobe signal LS.

The gray scale voltage generating circuit 35 generates voltages (gray scale voltages) VH1 to VH256 and VL1 to VL256 corresponding to 256 gray scale levels for each of the positive and negative polarities, based on a plurality of reference voltages provided from a predetermined power supply circuit (not shown), and outputs the voltages as a group of gray scale voltages. Note that how to set the value of each gray scale voltage will be described later.

The selection circuit 33 selects voltages from the group of gray scale voltages VH1 to VH256 and VL1 to VL256 outputted from the gray scale voltage generating circuit 35, based on the digital image signals d1 to dk outputted from the sampling latch circuit 32, and outputs the selected voltages. At this time, the polarities of the voltages selected from the group of gray scale voltages are determined based on a polarity reversal signal POL outputted from the display control circuit 100. The voltages outputted from the selection circuit 33 are inputted to the output circuit 34.

The output circuit 34 performs, by a voltage follower, for example, impedance conversion on the voltages outputted from the selection circuit 33, and outputs the converted voltages to the source bus lines SL(1) to SL(k), as driving video signals.

<4. Drive Method>

Figure 1:
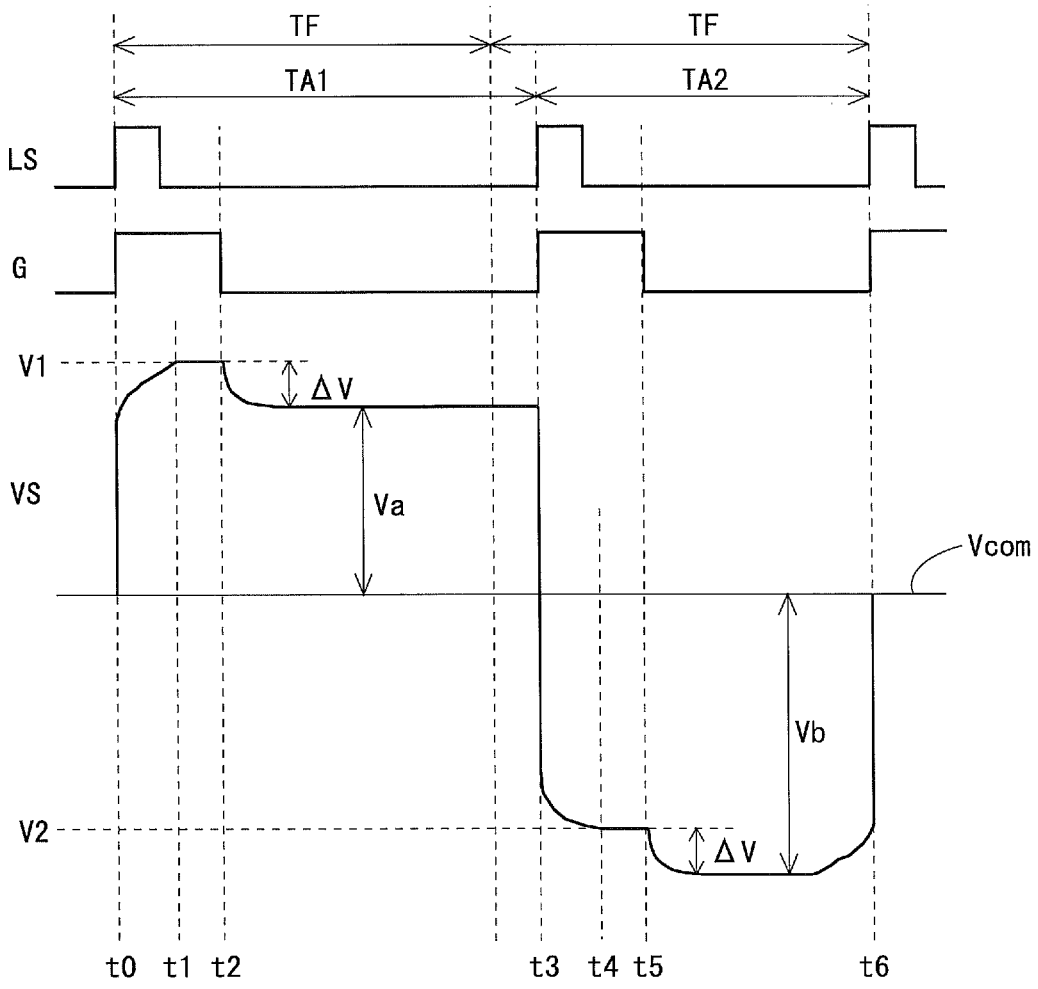
FIG. 1 is a signal waveform diagram for describing a drive method for a liquid crystal display device according to an embodiment of the present invention.

Next, with reference to FIG. 1, a drive method of the present embodiment will be described. Note that here a pixel formation portion to be focused is referred to as a "focused pixel formation portion". FIG. 1 shows the waveform of a latch strobe signal LS, the waveform of a scanning signal G provided to a gate bus line corresponding to a focused pixel formation portion, and the waveform of a voltage (pixel voltage) VS of the pixel electrode 41 of the focused pixel formation portion. Note, however, that, for the waveform of the latch strobe signal LS, among pulses to be generated, only those pulses related to charging of the focused pixel formation portion are shown. Note that in FIG. 1 the length of one conventional frame period is indicated by TF. Note also that in FIG. 1 it is assumed that, for the focused pixel formation portion, a period from a time point t0 to a time point t3 is a positive polarity charge period (a period during which a positive polarity voltage is applied to the liquid crystal), and a period from the time point t3 to a time point t6 is a negative polarity charge period (a period during which a negative polarity voltage is applied to the liquid crystal). In the present embodiment, the positive polarity charge period corresponds to a first charge period, and the negative polarity charge period corresponds to a second charge period.

When reaching the time point t0, the latch strobe signal LS rises, and the voltage of a video signal corresponding to the focused pixel formation portion changes so as to perform desired charging at the focused pixel formation portion. As such, the latch strobe signal LS is a signal including pulses indicating the timing of change in the voltage of the video signal outputted from the source driver 300. Note that the changed voltage of the video signal corresponding to the focused pixel formation portion is V1. At the time point t0, the scanning signal G also rises. By this, in the focused pixel formation portion, the thin film transistor 40 (see FIG. 3) is placed in an on state, and thus, the video signal is provided to the pixel electrode 41. As a result, the pixel voltage VS of the focused pixel formation portion increases and the pixel voltage VS reaches the voltage V1 of the video signal at a time point t1, for example. Thereafter, when reaching a time point t2, the scanning signal G falls. Due to the fall of the scanning signal G, the pixel voltage VS is reduced by ΔV (field-through voltage). By this, in the focused pixel formation portion, a voltage with a magnitude indicated by reference character Va in FIG. 1 is applied to the liquid crystal during the most part of the positive polarity charge period.

When reaching the time point t3, the latch strobe signal LS rises again, and the voltage of the video signal corresponding to the focused pixel formation portion changes so as to perform desired charging at the focused pixel formation portion. Note that the changed voltage of the video signal is V2. At the time point t3, the scanning signal G also rises. By this, in the focused pixel formation portion, the thin film transistor 40 is placed in an on state, and thus, the video signal is provided to the pixel electrode 41. As a result, the pixel voltage VS of the focused pixel formation portion decreases and the pixel voltage VS reaches the voltage V2 of the video signal at a time point t4, for example. Thereafter, when reaching a time point t5, the scanning signal G falls. Due to the fall of the scanning signal G, the pixel voltage VS is reduced by ΔV (field-through voltage). By this, in the focused pixel formation portion, a voltage with a magnitude indicated by reference character Vb in FIG. 1 is applied to the liquid crystal during the most part of the negative polarity charge period.

Figure 7:
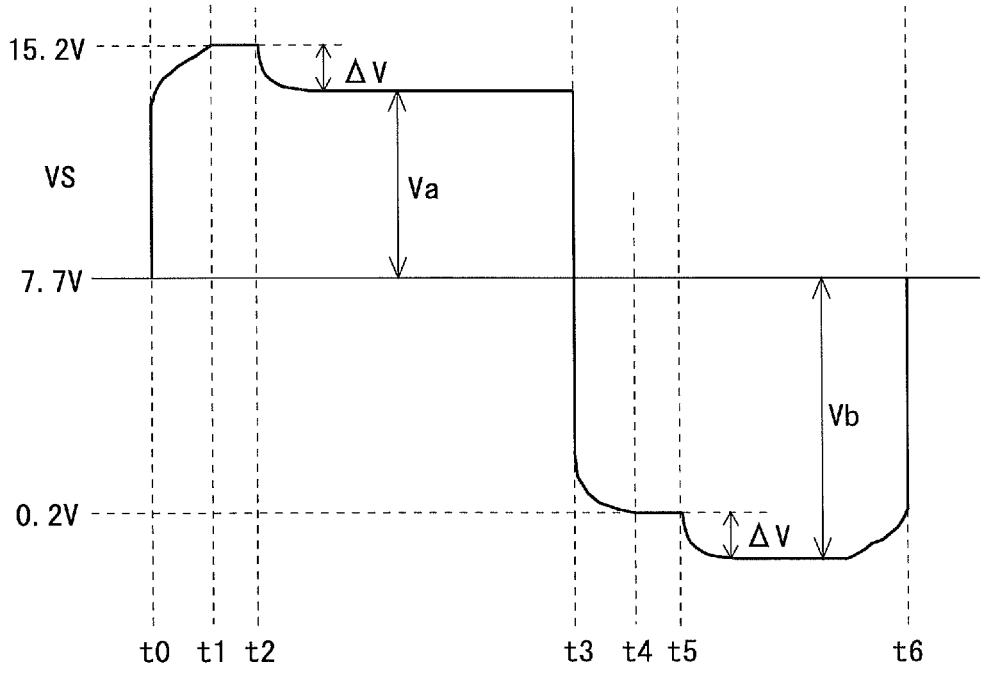
FIG. 7 is a signal waveform diagram showing an example of changes in pixel voltage in the embodiment.

Meanwhile, in the present embodiment, the value of Vcom is set to a median value between V1 and V2. As an example, as shown in FIG. 7, "V1=15.2 V, V2=0.2 V, and Vcom=7.7 V" are satisfied. Hence, taking into account the field-through voltage, the liquid crystal application voltage Va for the positive polarity charge period is smaller than the liquid crystal application voltage Vb for the negative polarity charge period. Hence, in order to obtain an equal charge rate between the positive polarity charge period and the negative polarity charge period, a length TA1 of a frame period serving as the positive polarity charge period is made longer than a length TA2 of a frame period serving as the negative polarity charge period.

<5. Regarding the Setting of the Values of a Common Electrode Voltage and Gray Scale Voltages>

Figure 8:
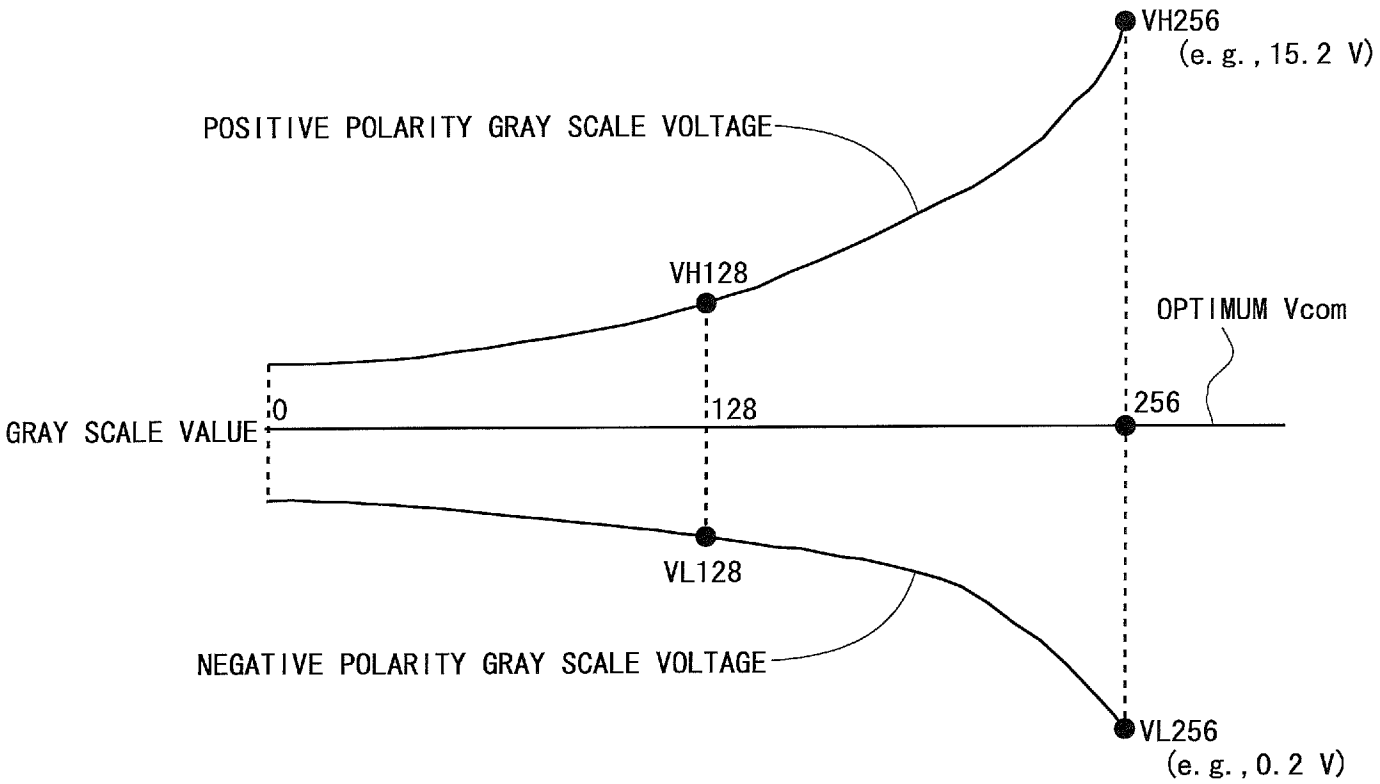
FIG. 8 is a diagram for describing the setting of the values of a common electrode voltage and gray scale voltages in the embodiment.
Figure 9:
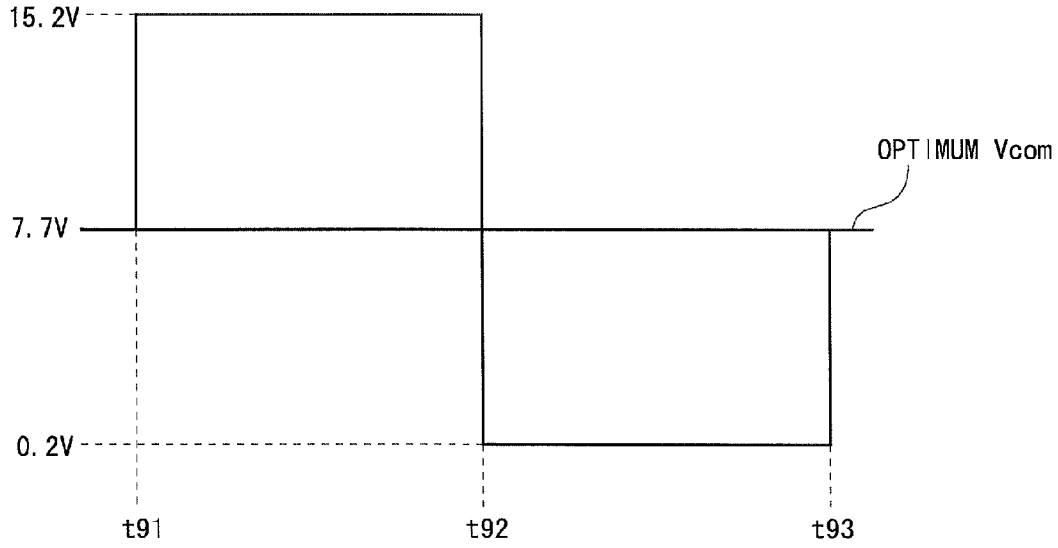
FIG. 9 is a waveform diagram showing changes in pixel voltage for when ideal driving is performed in a liquid crystal display device.
Figure 10:
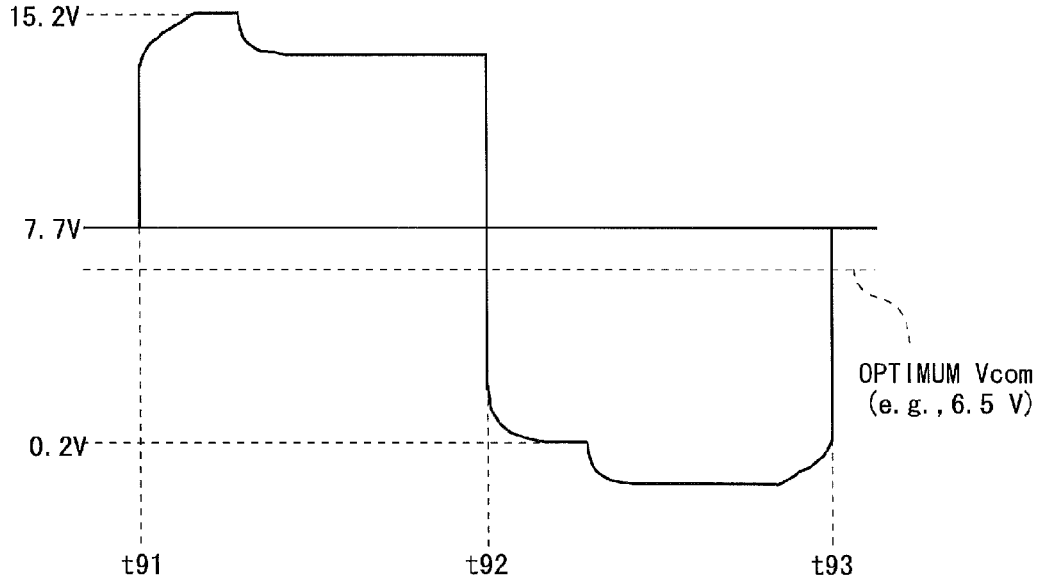
FIG. 10 is a waveform diagram showing actual changes in pixel voltage in the liquid crystal display device.

Next, the setting of the values of a common electrode voltage and gray scale voltages in the present embodiment will be described with reference to FIG. 8. Note that here the positive polarity gray scale voltage for a gray scale value n is indicated by VHn, and the negative polarity gray scale voltage for the gray scale value n is indicated by VLn. Note also that here description is made assuming that a liquid crystal display device is capable of performing 256 gray scale representation.

First, by minutely adjusting the length of the positive polarity charge period (TA1 in FIG. 1) and the length of the negative polarity charge period (TA2 in FIG. 1), the value of optimum Vcom for the case of performing display of the maximum gray scale (gray scale value=256) is determined. The value of optimum Vcom is set as the value of Vcom (the value of the common electrode voltage). Specifically, the value of Vcom is set such that the charge rate for the positive polarity charge period and the charge rate for the negative polarity charge period are equal to each other when display of the maximum gray scale is performed. Note that the value of the positive polarity gray scale voltage VH256 corresponding to the maximum gray scale and the value of the negative polarity gray scale voltage VL256 corresponding to the maximum gray scale are fixed values. For example, VH256 is 15.2 V, and VL256 is 0.2 V.

Then, the values of a positive polarity gray scale voltage (e.g., VH128) and a negative polarity gray scale voltage (e.g., VL128) corresponding to each gray scale other than the maximum gray scale are set such that the value of optimum Vcom for the case of performing display of the gray scale is equal to the value of optimum Vcom for the case of performing display of the maximum gray scale. In other words, for each gray scale other than the maximum gray scale, the values of positive polarity and negative polarity gray scale voltages corresponding to the gray scale are set such that the charge rate for the positive polarity charge period and the charge rate for the negative polarity charge period are equal to each other when the value of optimum Vcom for the case of performing display of the maximum gray scale is set as the value of Vcom.

<6. Adjustment of the Lengths of Charge Periods>

Next, adjustment of the lengths of charge periods in a liquid crystal display device that performs a plurality of types of frame-reversal driving will be described. Here, description is made assuming that a liquid crystal display device performs one-frame-reversal driving and two-frame-reversal driving. Note that the following description is an example and the present invention is not limited thereto.

First, the length of the positive polarity charge period and the length of the negative polarity charge period for two-frame-reversal driving are determined, and the value of optimum Vcom is determined in the manner described above. Then, the length of the positive polarity charge period and the length of the negative polarity charge period for one-frame-reversal driving are adjusted such that the value of optimum Vcom for the one-frame-reversal driving is equal to the value of optimum Vcom for the two-frame-reversal driving. The magnitude of the influence of a field-through voltage on the charge rate is greater in the one-frame-reversal driving than in the two-frame-reversal driving. Thus, when the length of the positive polarity charge period for the one-frame-reversal driving is T1*a*, the length of the negative polarity charge period for the one-frame-reversal driving is T1*b*, the length of the positive polarity charge period for the two-frame-reversal driving is T2*a*, and the length of the negative polarity charge period for the two-frame-reversal driving is T2*b*, normally, the lengths of the charge periods are adjusted such that "T1*a*>T2*a*>T2*b*>T1*b*".

<7. Effect>

According to the present embodiment, a pixel structure is adopted in which, when one gate bus line is focused, pixel formation portions that receive supply of a scanning signal from the gate bus line are arranged alternately on both sides of the gate bus line. Hence, while dot-reversal driving (a drive method in which the polarities of a liquid crystal application voltage for any two adjacent pixel formation portions are reversed from each other) is achieved, for charging of a plurality of pixel formation portions which is performed based on one pulse of a latch strobe signal, the polarities of a liquid crystal application voltage for the plurality of pixel formation portions can be made the same. By this, the length of the positive polarity charge period and the length of the negative polarity charge period can be made different from each other. Accordingly, by making the length of the positive polarity charge period longer than the length of the negative polarity charge period, for each frame-reversal driving, the value of optimum Vcom can be set to be near a median value of a video signal voltage. For example, by adjusting the length of the positive polarity charge period and the length of the negative polarity charge period for each of one-frame-reversal driving and two-frame-reversal driving, the value of optimum Vcom for both of the one-frame-reversal driving and the two-frame-reversal driving can be set to be near a median value of a video signal voltage. In the above-described manner, even when a plurality of types of frame-reversal driving are performed in one liquid crystal display device, the values of optimum Vcom for each reversal driving can be allowed to coincide with each other. By this, the occurrence of screen burn-in is prevented in a liquid crystal display device that performs a plurality of types of frame-reversal driving.

<8. Variants>

<8.1 Regarding the Value of a Common Electrode Voltage>

Although the value of Vcom is set to a median value of a video signal voltage in the above-described embodiment, the present invention is not limited thereto. The value of Vcom does not need to be a median value of a video signal voltage, provided that the lengths of charge periods are adjusted such that the value of optimum. Vcom for one-frame-reversal driving and the value of optimum Vcom for two-frame-reversal driving are equal to each other, and the value of optimum Vcom is set as the value of Vcom.

<8.2 Regarding Adjustment of the Lengths of Charge Periods>

In the above-described embodiment, when the length of the positive polarity charge period for one-frame-reversal driving is T1*a*, the length of the negative polarity charge period for the one-frame-reversal driving is T1*b*, the length of the positive polarity charge period for two-frame-reversal driving is T2*a*, and the length of the negative polarity charge period for the two-frame-reversal driving is T2*b*, the lengths of the charge periods are adjusted such that "T1*a*>T2*a*>T2*b*>T1*b*" is satisfied; however, the present invention is not limited thereto. The configuration may be such that the length of the positive polarity charge period and the length of the negative polarity charge period are be made equal to each other for two-frame-reversal driving and the length of the positive polarity charge period and the length of the negative polarity charge period for one-frame-reversal driving are adjusted such that the value of optimum Vcom for the two-frame-reversal driving and the value of optimum Vcom for the one-frame-reversal driving are equal to each other. Specifically, a liquid crystal display device that performs two-types of frame-reversal driving may be configured such that the lengths of charge periods are adjusted for only one type of frame-reversal driving.

DESCRIPTION OF REFERENCE CHARACTERS

100: DISPLAY CONTROL CIRCUIT
200: GATE DRIVER (SCANNING SIGNAL LINE DRIVE CIRCUIT)
300: SOURCE DRIVER (VIDEO SIGNAL LINE DRIVE CIRCUIT)
400: DISPLAY UNIT
G: SCANNING SIGNAL
GL: GATE BUS LINE
LS: LATCH STROBE SIGNAL
SL: SOURCE BUS LINE
SL: SOURCE BUS LINE
Vcom: COMMON ELECTRODE VOLTAGE
VS: PIXEL VOLTAGE

The invention claimed is:

1. An active matrix-type liquid crystal display device comprising:

a plurality of video signal lines for transmitting a plurality of video signals, respectively, the video signals representing an image to be displayed;

a plurality of scanning signal lines that intersect the plurality of video signal lines;

a plurality of pixel electrodes provided in a plurality of pixel formation portions, respectively, the pixel formation portions being arranged in a matrix corresponding respectively to intersections of the plurality of video signal lines and the plurality of scanning signal lines;

a common electrode provided so as to be shared by the plurality of pixel electrodes, and provided so as to face the plurality of pixel electrodes with a liquid crystal there between;

a video signal line drive circuit that outputs the plurality of video signals to the plurality of video signal lines; and a scanning signal line drive circuit that outputs a plurality of scanning signals to sequentially drive the plurality of scanning signal lines, wherein when any scanning signal line is focused, among the plurality of pixel electrodes, pixel electrodes provided in pixel formation portions to which the corresponding scanning signal is provided from the focused scanning signal line are arranged in a staggered manner with the focused scanning signal line centered, in each pixel formation portion, a period during which a positive polarity voltage is applied to the liquid crystal is longer than a period during which a negative polarity voltage is applied to the liquid crystal, one-frame-reversal driving where a polarity of a voltage applied to the liquid crystal is reversed every frame and multi-frame-reversal driving where the polarity of the voltage applied to the liquid crystal is reversed every multiple frames are switchable, when at least the one-frame-reversal driving is performed, in each pixel formation portion, a period during which a positive polarity voltage is applied to the liquid crystal is longer than a period during which a negative polarity voltage is applied to the liquid crystal, when a length of a period during which a positive polarity voltage is applied to the liquid crystal in each pixel formation portion when the one-frame-reversal driving is performed is T1*a*, a length of a period during which a negative polarity voltage is applied to the liquid crystal in each pixel formation portion when the one-frame-reversal driving is performed is T1*b*, a length of a period during which a positive polarity voltage is applied to the liquid crystal in each pixel formation portion when the multi-frame-reversal driving is performed is T2*a*, and a length of a period during which a negative polarity voltage is applied to the liquid crystal in each pixel formation portion when the multi-frame-reversal driving is performed is T2*b*, a following equation holds:

$$T1a>T2a>T2b>T1b.$$

2. The liquid crystal display device according to claim 1, further comprising a display control circuit that controls operation of the video signal line drive circuit and the scanning signal line drive circuit, and that generates a latch strobe signal including pulses and provides the latch strobe signal to the video signal line drive circuit, the pulses indicating timing of change in voltages of the plurality of video signals outputted from the video signal line drive circuit, wherein when a period from a time point of generation of a pulse for changing the voltages of the plurality of video signals so as to change a polarity of a voltage applied to the liquid crystal from negative to positive to a time point of generation of a pulse for changing the voltages of the plurality of video signals so as to change the polarity of the voltage applied to the liquid crystal from positive to negative is defined as a first charge period, and a period from a time point of generation of a pulse for changing the voltages of the plurality of video signals so as to change the polarity of the voltage applied to the liquid crystal from positive to negative to a time point of generation of a pulse for changing the voltages of the plurality of video signals so as to change the polarity of the voltage applied to the liquid crystal from negative to positive is defined as a second charge period, the display control circuit generates, as the latch strobe signal, a signal including pulses where the first charge period is longer than the second charge period.

3. The liquid crystal display device according to claim 1, further comprising a gray scale voltage generating circuit that generates a plurality of gray scale voltages including positive polarity side and negative polarity side voltages corresponding to displayable gray scales, the gray scale voltages being voltages to be outputted from the video signal line drive circuit, as the video signals, wherein a voltage value of the common electrode is set such that a charge rate for a period during which a positive polarity voltage is applied to the liquid crystal and a charge rate for a period during which a negative polarity voltage is applied to the liquid crystal are equal to each other when display of a maximum gray scale is performed, and in the gray scale voltage generating circuit, values of positive polarity side and negative polarity side gray scale voltages corresponding to each gray scale other than the maximum gray scale among the plurality of gray scale voltages are set such that a charge rate for a period during which a positive polarity voltage is applied to the liquid crystal and a charge rate for a period during which a negative polarity voltage is applied to the liquid crystal are equal to each other when display of the gray scale is performed.

* * * * *